US005379889A

United States Patent [19]

Cobler

[11] Patent Number: 5,379,889

[45] Date of Patent: Jan. 10, 1995

[54] CIGARETTE PACKAGE

[75] Inventor: Larry D. Cobler, Winston-Salem, N.C.

[73] Assignee: R. J. Reynolds Tobacco Company, Winston-Salem, N.C.

[21] Appl. No.: 142,253

[22] Filed: Oct. 22, 1993

[51] Int. Cl.[6] ..... B65D 85/10

[52] U.S. Cl. ..... 206/268; 206/265; 229/160.1

[58] Field of Search ..... 206/252, 265, 268, 271, 206/273; 229/123, 128, 130, 160.1

[56] References Cited

U.S. PATENT DOCUMENTS

| | | |
|---|---|---|
| 356,244 | 1/1887 | Emery . |
| 1,306,574 | 6/1919 | Boerlin . |
| 1,440,270 | 12/1922 | Bertherman . |
| 1,725,869 | 8/1929 | Kornsweet . |
| 1,742,657 | 1/1930 | Littell . |
| 1,897,702 | 2/1933 | Lewnes . |
| 1,967,204 | 7/1934 | Genz . |
| 2,107,826 | 2/1938 | Keller . |
| 2,219,179 | 10/1940 | Fayer et al. . |
| 2,247,870 | 7/1941 | Chalmers . |
| 2,265,828 | 12/1941 | Wilson . |
| 2,353,761 | 7/1944 | Ringler . |
| 2,508,193 | 5/1950 | Rigler ..... 229/160.1 |
| 2,704,182 | 3/1955 | Sandler . |
| 2,825,343 | 3/1958 | Richner . |
| 2,901,097 | 8/1959 | Tamarin . |
| 2,902,201 | 9/1959 | Engblom . |
| 2,956,722 | 10/1960 | Prussack . |
| 2,960,264 | 11/1960 | Walter . |
| 2,983,424 | 5/1961 | Glass . |
| 2,997,221 | 8/1961 | Gimple . |
| 3,037,683 | 6/1962 | Sherrill . |
| 3,039,671 | 6/1962 | Chiamandas . |
| 3,052,398 | 9/1962 | Benjamin . |
| 3,078,029 | 2/1963 | Lacey . |
| 3,207,416 | 9/1965 | Koltz et al. . |
| 3,270,945 | 9/1966 | Whitaker et al. . |
| 3,533,550 | 10/1970 | Benzon-Petersen . |
| 3,765,593 | 10/1973 | D'Alessio . |
| 3,823,865 | 7/1974 | Mechnick . |
| 4,172,520 | 10/1979 | Gero . |
| 4,240,548 | 12/1980 | Stio . |
| 4,294,399 | 10/1981 | Wilfer . |
| 4,372,443 | 2/1983 | Woo Seop . |
| 4,375,260 | 3/1983 | Focke et al. . |
| 4,513,863 | 4/1985 | Schillinger . |
| 4,913,292 | 4/1990 | Field . |
| 4,961,496 | 10/1990 | Focke et al. . |
| 5,014,906 | 5/1991 | Gero . |
| 5,139,140 | 8/1992 | Burrows et al. . |

FOREIGN PATENT DOCUMENTS

| | | |
|---|---|---|
| 744558 | 2/1956 | United Kingdom . |

*Primary Examiner*—David T. Fidei

[57] ABSTRACT

A blank for a hinged lid cigarette package which can have cigarettes removed therefrom as is common for a hinged lid package or as is common for a soft package. The hinged lid package includes a top panel having an opening which permits cigarettes to be removed from the package. A movable closure wall is provided which can be opened to allow removal of cigarettes from the package and closure of the package.

5 Claims, 3 Drawing Sheets

CIGARETTE PACKAGE

BACKGROUND OF THE INVENTION

The present invention relates to a package for smoking articles such as cigarettes, and in particular to a cigarette package of the hinged lid type.

Popular smoking articles such as cigarettes conventionally have been sold in packages. Typically, each package contains about 20 cigarettes.

One type of popular cigarette package is the so-called "hard-pack," "crush proof box" or "hinged lid package." Such a package has a generally cuboid-type shape, is manufactured from resilient paperboard, and includes an outer wrap of transparent polypropylene film. Hinged lid cigarette packages conventionally are made from two paperboard blanks. One blank forms the body and lid of the package. The second blank forms an insert or inner frame which is assembled to the inside of the front and side walls of the package. The inner frame projects above the front and side walls of the package body, and provides a seal between the lid and body when the package is closed. See, for example, U.S. Pat. No. 4,852,734 to Allen, et al., which is incorporated herein by reference. Other types of designs of blanks for hinged lid cigarette packages can be of the type described in U.S. Pat. Nos. 3,874,581 to Fox et al., and 3,944,066 to Niepmann.

Cigarettes also can be packaged in a container having the form of a so-called "soft pack." See, for example, U.S. Pat. Nos. 3,695,422 to Tripodi and 4,717,017 to Sprinkle, Jr., et al. Cigarettes are removed from a soft package by tearing away a portion of the top of the package, in order that cigarettes can be easily accessed from the top of the package.

If would be highly desirable to provide a hinged lid type cigarette package which can have cigarettes removed therefrom in a variety of ways. See also U.S. Pat. No. 5,139,140.

SUMMARY OF THE INVENTION

The present invention relates to the foldable blank for a hinged lid package for smoking articles such as cigarettes.

The blank includes a front body panel and two front side panels on each side thereof and a bottom panel at one end of the front body panel. Attached to the opposite side of the bottom panel from the front side panel is a rear panel including a rear body panel adjacent the bottom panel and a rear lid panel on the opposite end thereof. The rear body panel has rear body side panels attached to each side thereof, while the rear lid panel has rear lid side panels attached thereto. A top panel is attached to the rear lid panel and has an opening or cutout therein. The rear lid side panels have top flaps attached thereto which are adjacent the top panel. The rear lid side panel adjacent the opening in the top panel has a plurality of parallel perforated lines. One is located at the juncture between the rear lid side panel and the top flap. Two additional perforated lines are parallel to and equally spaced from one another and from the perforation at the juncture line. The top flap panel has a crease line and a tab notch cutout. When formed in a package, the top flap closes the opening in the top panel and is movable between an open and close position.

The blank of the present invention forms a package which includes a body portion and a lid portion which is integrally hinged to the body portion. The body portion includes a front wall, a bottom wall, a rear wall, inner side walls and outer side walls. The lid portion includes a front wall, a top wall, a rear wall integrally hinged to the rear wall of the body portion, inner side walls and outer side walls. The top wall of the package includes an opening through which smoking articles can be removed from the package. The package also includes a slidable closure wall which closes the opening in the top wall and is movable to expose the cigarettes and permit their removal from the package. Thus, the formed package can be employed as a conventional hinged lid package, or in a similar manner to a soft package (e.g., so as to gain access to the cigarettes through the top of the package).

By use of the foldable blank (e.g., paperboard blank) of the present invention, the package can be manufactured in much the same way as conventional hinged lid cigarette packages, filled with cigarettes using conventional cigarette packaging technology, and overwrapped with outer wrap as is conventional in the cigarette packaging art.

The package made from the blank of the present invention includes the desirable features of both the hinged lid package design and the soft package design. For example, the package is reclosable so as to protect the cigarettes contained therein and minimize the loss or spillage of particles of tobacco or cut filler from an open package and the package allows the removal of cigarettes from the package without opening the entire hinged lid portion if the user desires.

DETAILED DESCRIPTION OF PREFERRED EMBODIMENTS

Figure 1:
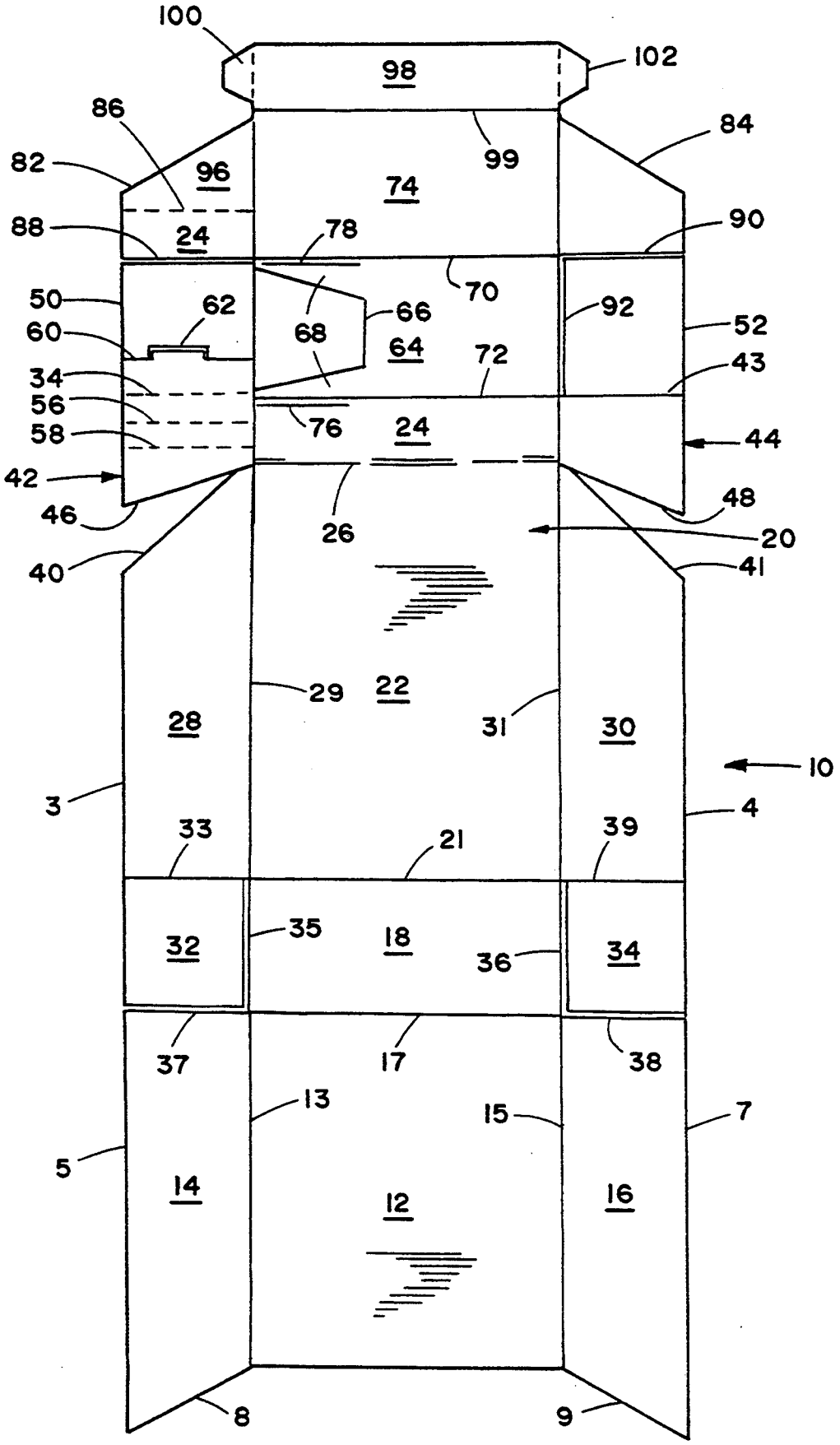
FIG. 1 is a plan view of one blank embodiment of the present invention for use in forming the hinged lid package.

In FIG. 1, the blank 10 of the present invention is preferably formed of a paperboard sheet and is generally rectangular in configuration. The paperboard sheet has a plurality of fold lines, creases or scores (shown as solid lines in FIG. 1); perforations (shown as dotted lines in FIG. 1); and a plurality of cuts. The degree of perforation can vary and be provided to ensure the proper removal of a portion of the blank or that the blank will fold appropriately.

The cuts conveniently are made by slitting the blank without removing material therefrom; however, for illustration purposes, the slits are shown in FIG. 1 as narrow slots. The folds, perforations and cuts define the panels which correspond to the walls and flaps of the package which is constructed of the blanks. The folds, perforations and cuts are provided using techniques readily apparent to the skilled artisan. Generally, each of the panels forming the blank are parallelepipid, such as rectangular or square.

The blank 10 includes a rectangular front body panel 12 having front body side panels 14 and 16 integrally formed therewith and extending along each side of the front body panel. The front body panel 12 and the front body side panels being defined by fold or crease lines 13 and 15. The outer side edges 5 and 7 of the front body side panels are longer than the fold line 13 and 15; therefore, the outer end edges 8 and 9 of the front body side panels are obliquely cut.

A bottom panel 18 is integrally formed with one edge of the front body panel and is separated therefrom by a fold line 17.

Integrally formed with the bottom panel 18 is a rear panel 20 which is attached to the edge of the bottom panel opposite the front body panel along fold line 21. The rear panel 20 includes a rear body panel 22 and a rear lid panel 24 which are separated by a hinged fold line 26 consisting of crease and slits to permit the rear lid panel 24 to pivot about the hinged line when the blank is formed into a package. The rear body panel has rear body side panels 28 and 30 formed integrally therewith along each side of the rear body panel and separated by fold line 29 and 31. At the end of each of the rear body side panels adjacent the bottom panel 18 are bottom flap panels 32 and 34 which are formed integrally with the rear body side panels and separated by fold line 33 and 39. The bottom flaps are separated from the bottom panel 18 and their respective front side panels by slits 35, 36, 37 and 38. The outer side edge 3 and 4 of the rear body side panels are shorter than the fold line 29 and 31; therefore, the end edge 40 and 41 of each of the rear body side panels opposite bottom flaps is cut at an oblique angle.

The rear lid panel 24 of the rear panel has rear lid side panels 42 and 44 formed integrally therewith. The edge 46 and 48 of each rear lid side panel adjacent the rear body side panels has an oblique cut thereby forming a between the upper edge of the rear body side panels and the lower edge of the rear lid side panels.

Figure 4:
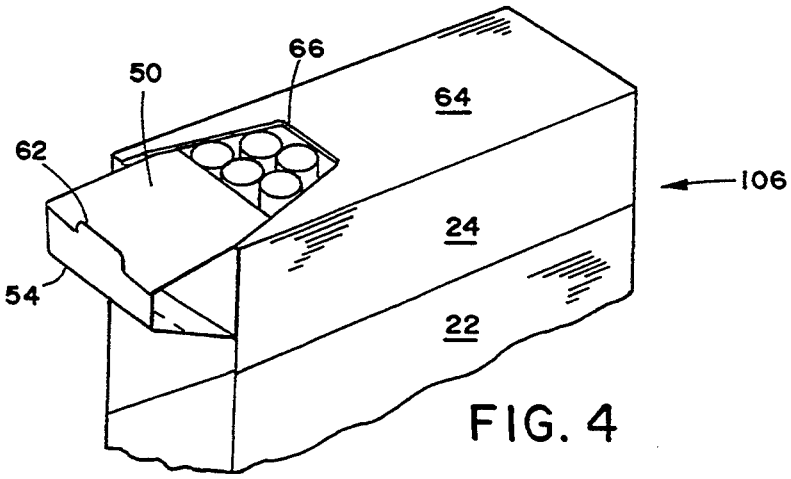
FIG. 4 is a perspective of the upper portion of the assembled package formed by the blank of FIG. 1 in the open position.

Integrally formed with the rear lid side panels 42 and 44 and opposite the rear body side panels are top side flaps 50 and 52. Top side flap 52 is separated from its rear lid side panel 44 and a fold line 43. One of the top flaps 50 forms the movable closure wall for the package when the blank is formed. The top side flap 50 which forms the closure wall and the rear lid side panel 42 are separated by a perforated fold line 54. The rear lid side panel has two perforated fold lines 56 and 58 parallel to the perforated fold line 54 which are equally spaced from one another. The top side flap 50 has a broken score line 60 with a notched tab cut 62 intermittent the score line. The notched tab permits the user of the assembled package to engage the closure wall to open the package while the broken score line permits the closure wall to bend upon opening of the package. The perforated fold lines 54, 56 and 58 permit the closure wall to be moved outwardly to open the package as can be seen in FIG. 4.

Figure 2:
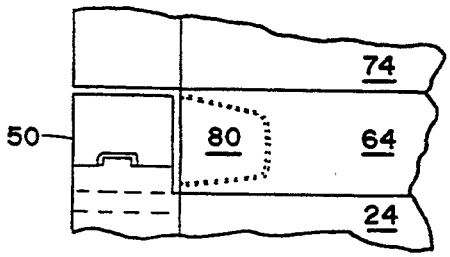
FIG. 2 is a partial plan view of another blank embodiment of the present invention.

Attached to the edge of the rear lid panel 24 is a top panel 64. The top panel has an opening or cutout 66 that extends inwardly from the side edge of the top panel adjacent the top flap 50. The width of the cutout is less than the width of the top panel so that closure retaining edge strips 68 are provided on opposite sides of the cutout. The retaining edge strips permit the closure wall to slide beneath them while the closure wall is maintained generally in the plane of the top panel in the assembled package. The cutout 66 extends inwardly a sufficient distance to provide an opening to permit the contents of the package to be removed when the closure wall is opened. Fold lines 70 and 72 between the top panel and the rear lid panel and a front lid panel 74 are provided with slits 76 and 78 approximately the length of the inward extent of the cutout. The slits 76 and 78 permit the fold to be made without disturbing the closure retaining edge strips 68. Although in the preferred blank embodiment the top panel has a cutout, the blank can be formed so that the top panel is provided with a removable portion 80 (see FIG. 2) which can be removed to form the opening in the top panel 64.

The front lid panel 74 has front lid side flaps 82 and 84. The front lid side flap 82 adjacent the top side flap 50 is divided into two portions 94 and 96 by a perforated line 86 parallel to the edge of the flap. Slits 88 and 90 are provided between the top flap 50 and 52 and the front lid side panel 82 and 84 and slit 92 separates the top flap 52 and the top panel 64. The perforated line 86 permits the inner portion 94 of front lid side panel 82 to be either removed along the perforated line or folded back when the closure panel is open.

Attached to the edge of the front lid panel 74 opposite the top panel along fold line 99 is a lid reinforcing panel 98 with two tabs 100 and 102 which reinforce the front edge and corners of the lid in the assembled packages.

Figure 3:
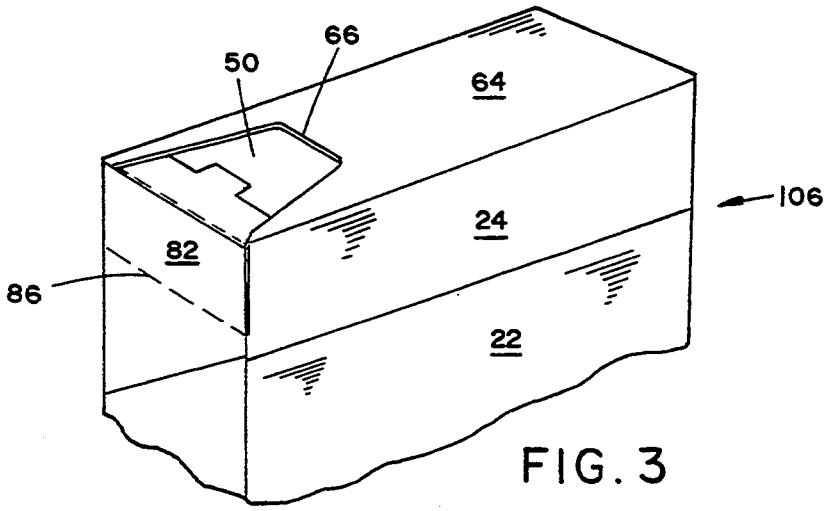
FIG. 3 is a perspective of an upper portion of the assembled package formed by the blank illustrated in FIG. 1 in the closed position.

In FIG. 3, the blank 10 is folded and assembled to form a package 106. The top flap 50 of the blank which becomes the closure wall of the package is illustrated in the closed position. In FIG. 4, the package 106 is illustrated with the closure wall in the open position exposing the contents of the package.

Figure 5:
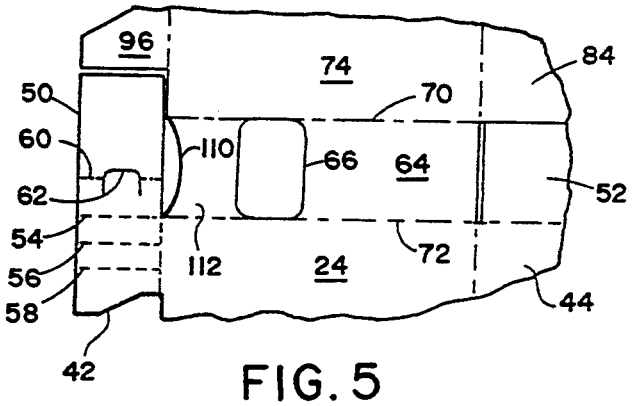
FIG. 5 is a partial plan view of another blank embodiment of the present invention.

In FIG. 5, the top panel 64 has two cutouts 66 and 110. Cutout 66 is spaced from the side edge of the top panel and is generally rectangular in shape, extending across the top panel between fold lines 70 and 72. Cutout 66 is the opening through which the smoking articles can be removed from the assembled package. A curved or arcuate cutout 110 is adjacent the side edge of the top panel adjacent to the top flap 50. The cutouts are separated by a closure retaining strip 112. In this embodiment, the top flap 50 is extended and is wider than the width of the top panel 64. As in the embodiment shown in FIG. 1, the top flap 50 acts as the closure wall for the assembled package and its length will be dependent upon the position of the cutout 66 in the top panel. The notched tab 62 is also cut differently than the notched tab illustrated in FIG. 1. The sides of the notched tab cutout 62 extend generally from the broken scored line 60 towards the juncture fold line 54. The notched tab cut is made larger in this embodiment.

Figure 6:
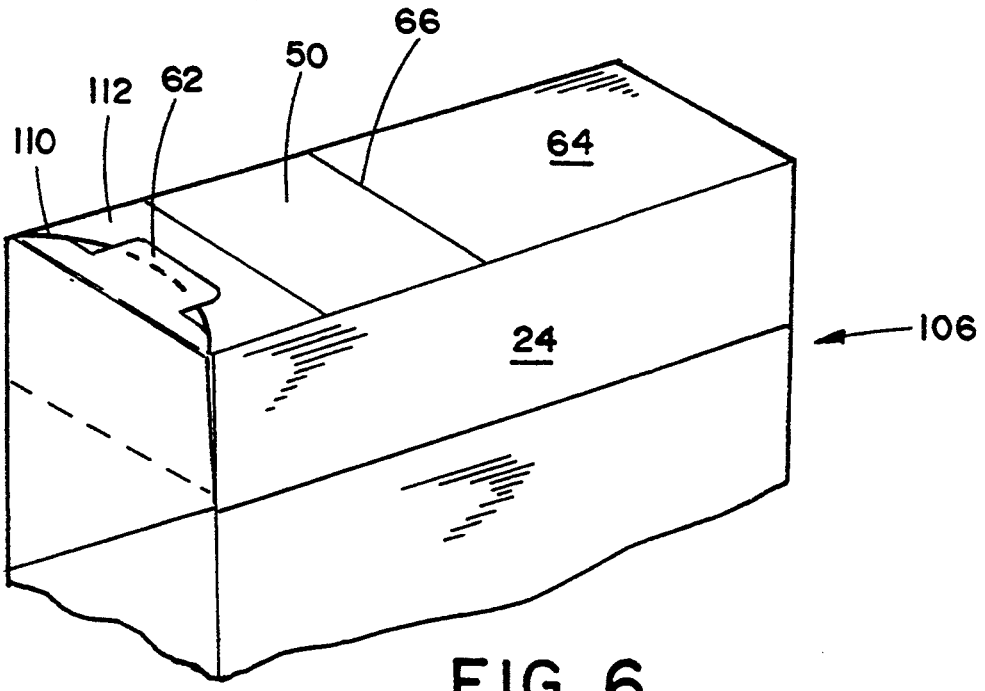
FIG. 6 is a perspective of an upper portion of the assembled package formed by the blank illustrated in FIG. 5 in the closed position.
Figure 7:
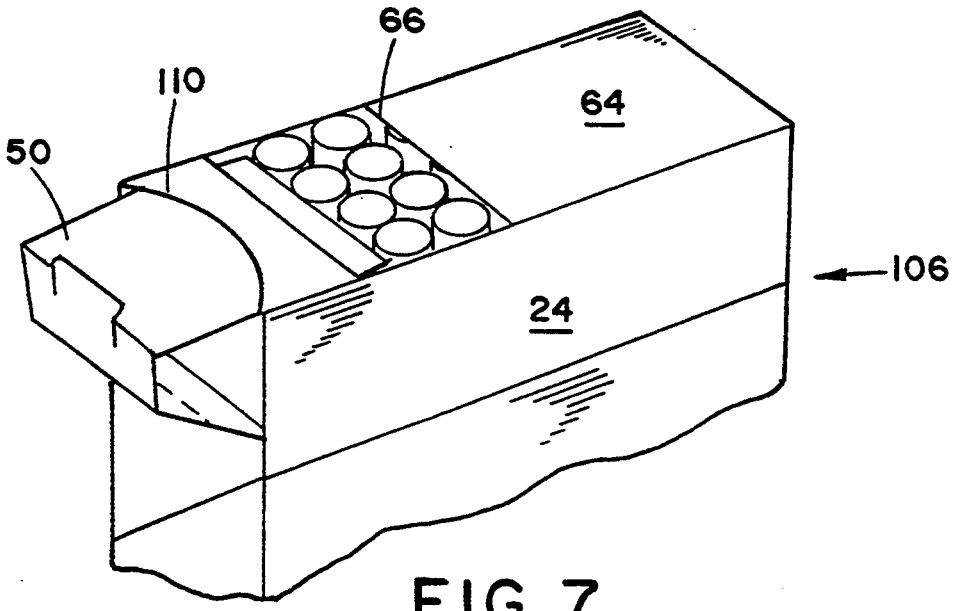
FIG. 7 is a perspective of the upper portion of the assembled package formed by the blank of FIG. 5 in the closed position.

FIGS. 6 and 7 illustrate the blank in the folded and assembled to form a package 106. The top flap 50 of the blank, which becomes the closure wall of the package, is illustrated in the closed position in FIG. 6 and in the open position in FIG. 7. The curved cutout 110 permits the user to engage the edge of the top panel so that the closure wall can be opened as illustrated in FIG. 7. When the package is first assembled, the tab cutout 62 is positioned under the retaining strip 112; however, after the initial opening of the closure wall, the tab cutout 62 may then be positioned on top of the retaining strip 112 to maintain the form of the package as well as preventing the closure wall from moving and providing the additional area to be grasped when the user subsequently opens the package.

What is claimed is:

1. A blank for a hinged lid cigarette package, the blank comprising:

a) a front body panel, with front body side panels on each side thereof;

b) a bottom panel at one end of the front body panel;

c) a rear panel attached to the bottom panel and including (i) a rear body panel and, (ii) a rear lid panel;

d) the rear body panel having a rear body side panel with a bottom flap attached to each side thereof;

e) the rear lid panel having rear lid side panel with top flaps attached to each side thereof;

f) attached to the rear lid panel is a top panel;

g) attached to the top panel is a front lid panel having front lid side panel attached to each side thereof; wherein said top panel has a cutout therein and at least one of the rear lid side panels having a plurality of parallel perforated lines, one of such perforated lines separating the rear lid side panel from said top flap, said top flap having a notched tab cut.

2. The blank of claim 1, wherein the cutout is adjacent to the side of the top panel that is adjacent to the top flap having the notched tab cut.

3. The blank of claim 2, further including a closure retaining strip on opposite side of the cutout.

4. The blank of claim 2, wherein the top panel has a second cutout which is spaced from the side of the top panel adjacent to the side of the top panel that is adjacent to the top flap having the notched tab cut.

5. The blank of claim 4, wherein the top flap having the notched tab cutout is larger than the width of the top panel.

* * * * *